US009909420B2

(12) United States Patent
Andersen

(10) Patent No.: US 9,909,420 B2
(45) Date of Patent: Mar. 6, 2018

(54) AXIAL PISTON MACHINE

(71) Applicant: Danfoss A/S, Nordborg (DK)

(72) Inventor: Stig Kildegaard Andersen, Krusaa (DK)

(73) Assignee: Danfoss A/S, Nordborg (DK)

( * ) Notice: Subject to any disclaimer, the term of this patent is extended or adjusted under 35 U.S.C. 154(b) by 272 days.

(21) Appl. No.: 15/017,841

(22) Filed: Feb. 8, 2016

(65) Prior Publication Data

US 2016/0230555 A1 Aug. 11, 2016

(30) Foreign Application Priority Data

Feb. 11, 2015 (EP) ..... 15154616

(51) Int. Cl.

| | |
|---|---|
| ***F01B 3/00*** | (2006.01) |
| ***F04B 1/12*** | (2006.01) |
| ***F04B 1/20*** | (2006.01) |
| ***F04B 53/14*** | (2006.01) |

(52) U.S. Cl.

CPC ..... *F01B 3/0082* (2013.01); *F01B 3/0088* (2013.01); *F04B 1/12* (2013.01); *F04B 1/126* (2013.01); *F04B 1/2014* (2013.01); *F04B 1/2071* (2013.01); *F04B 1/2078* (2013.01); *F04B 1/2085* (2013.01); *F04B 1/2092* (2013.01); *F04B 53/14* (2013.01)

(58) Field of Classification Search

CPC ..... F01B 3/0088; F04B 1/126

USPC ..... 92/12, 157

See application file for complete search history.

(56) References Cited

U.S. PATENT DOCUMENTS 6,024,011 A * 2/2000 Bergmann ..... F04B 1/124 92/157

2006/0174758 A1 8/2006 Beck

FOREIGN PATENT DOCUMENTS

| | | | |
|---|---|---|---|
| CN | 101595304 | A | 12/2009 |
| CN | 203730241 | U | 7/2014 |
| DE | 36 14 257 | A1 | 10/1987 |
| DE | 10 2006 061 145 | A1 | 6/2008 |
| DE | 10 2012 013 202 | A1 | 1/2014 |
| DE | 10 2012 014 538 | A1 | 1/2014 |
| JP | H09-209920 | A | 8/1997 |
| WO | 2004/083635 | A1 | 9/2004 |

* cited by examiner

*Primary Examiner* — F. Daniel Lopez
*Assistant Examiner* — Daniel Collins
(74) *Attorney, Agent, or Firm* — McCormick, Paulding & Huber LLP

(57) ABSTRACT

An axial piston machine is shown comprising a cylinder drum rotatable around an axis of rotation and having at least a cylinder, a piston arranged in said cylinder, a swash plate arranged in front of said cylinder drum, said piston being provided with a slipper (11) resting against said swash plate and having a pressure area (17) on a side facing said swash plate, wherein a cylinder axis of said cylinder is arranged on a circle line (27) around said axis of rotation (16). Such a machine should be made compact. To this end said pressure area (17) deviates from a circular form.

20 Claims, 2 Drawing Sheets

AXIAL PISTON MACHINE

CROSS REFERENCE TO RELATED APPLICATION

Applicant hereby claims foreign priority benefits under U.S.C. § 119 from European Patent Application No. EP15154616.5 filed on Feb. 11, 2015, the content of which is incorporated by reference herein.

TECHNICAL FIELD

The present invention relates to an axial piston machine comprising a cylinder drum rotatable around an axis of rotation and having at least a cylinder, a piston arranged in said cylinder, a swash plate arranged in front of said cylinder drum, said piston being provided with a slipper resting against said swash plate and having a pressure area on a side facing said swash plate, wherein a cylinder axis of said cylinder is arranged on a circle line around said axis of rotation.

BACKGROUND

Such an axial piston machine can be used as axial piston pump or axial piston motor. The swash plate is angled with respect to the axis of rotation. When the axial piston machine is used as motor, the cylinder is supplied with hydraulic fluid under pressure pressing the piston out of the cylinder. The slipper which contacts the swash plate generates a grade resistance driving the cylinder drum in rotation about the axis of rotation. When the axial piston machine is used as pump the cylinder drum is driven in a rotational movement from the outside. The slipper of the piston together with the contact at the swash plate forces the piston to move back and forth within the cylinder thereby pressurizing the hydraulic fluid.

The slipper is pressed against the swash plate by the pressure within the cylinder and by means of a retaining mechanism. In order to avoid too much wear in the swash plate and the slipper a pressure area is provided on the slipper which is pressurized as well, in many cases by the pressure of the hydraulic fluid within the cylinder. The size of the pressure area multiplied with the pressure in the pressure area creates a force which should balance out the force generated by the pressure within the cylinder and acting on the piston. The total pressure area is a combination of a high pressure area and a seal area. The pressure in the seal area decreases from the radially inner side to the radially outer side and is in average therefore lower than the pressure in the high pressure area. Furthermore, the slipper is tilted. This makes it necessary to define the pressure area to be larger than the inner diameter of the cylinder. This requires a certain space to accommodate the desired number of cylinders in the cylinder drum.

SUMMARY

The object underlying the invention is to make a compact axial piston machine.

This object is solved with a hydraulic machine as described at the outset in that said pressure area deviates from a circular form.

In this way it is possible to enlarge the pressure area without having the necessity to change the position of the cylinder. It is still possible to have a large number of cylinders thereby keeping a distance between cylinders in circumferential direction small. Since the pressure area deviates from the circular form it can be extended, for example radially to the inside or radially to the outside, to increase the pressure area. An increase of the pressure area increases the force generated by the pressure in the pressure area so that a better equilibrium between the force pressing the slipper against the swash plate and the force pressing the slipper away from the swash plate can be achieved.

In a preferred embodiment said pressure area comprises a radially inner border and a radially outer border and said radially inner border has a larger distance to said circle line than said radially outer border. This uses the fact that the space encircled by the circle line has not been used to an extent possible. When now the radially inner border is positioned with a larger distance to the circle line than the radially outer border the pressure area is extended to the radial inside thereby increasing the area.

Preferably said radially inner border has a distance to said circle line which is larger than a distance of the circumference of the largest possible circle around said cylinder axis defined by a size of said cylinder drum and the number of cylinders of said cylinder drum. When a certain number of cylinders are accommodated in the cylinder drum the largest possible circle has a diameter corresponding to the length of the circle line divided by the number of cylinders. The corresponding radius is half of this diameter. The radially inner border of the pressure area has distance to the circle line which is larger than the radius of the largest possible circle so that the pressure area is enlarged radially inwardly.

Preferably said pressure area comprises in an area radially outside said circle line at least one enlargement extending in circumferential direction around said axis of rotation. In the cylinder drum there is one sector of a circle available for each cylinder. This sector increases its width in circumferential direction viewed radially to the outside. This increase in width can be used to enlarge the pressure area, since this enlargement is located radially outside of the circle line.

In a particular preferred embodiment said pressure area has a wedge-like form. This wedge-like form is basically a triangle. It takes into account the above mentioned sector of the circular form of the cylinder drum.

Preferably said pressure area is limited by a wall having straight sections, said straight sections being connected by rounded sections. The term "straight sections" is not necessarily meant in a mathematically defined sense. The straight section can be slightly curved. However, the shape defined simplifies manufacturing of the pressure area.

Preferably at least two rounded sections are located radially outside said circle line and at least one rounded section is located radially inside said circle line. In the simplest form the pressure area has the form of a triangle with rounded edges, the base of the triangle being located radially outside the circle line.

Preferably said pressure area is symmetric with respect to a radius line of said circle line. This produces the same conditions independently of the direction of rotation of the cylinder drum.

Preferably said pressure area has three axis of symmetry. When the pressure area is in the form of a wedge or of a triangle, this triangle is a triangle with three equal sides.

Preferably said cylinder is connected to said pressure area by a channel running through said piston, said channel opening into said pressure area at a position on a radially inner side of said circle line. The pressure within the pressure area which is influenced by the pressure in the cylinder can be distributed equally over the whole pressure area without being deferred.

Preferably said position is located in the center of the pressure area. This gives the best equilibrium for the generation of pressure forces.

BRIEF DESCRIPTION OF THE DRAWINGS

A preferred example of the invention will now be described in more detail with reference to the drawing, wherein.

DETAILED DESCRIPTION

Figure 1:
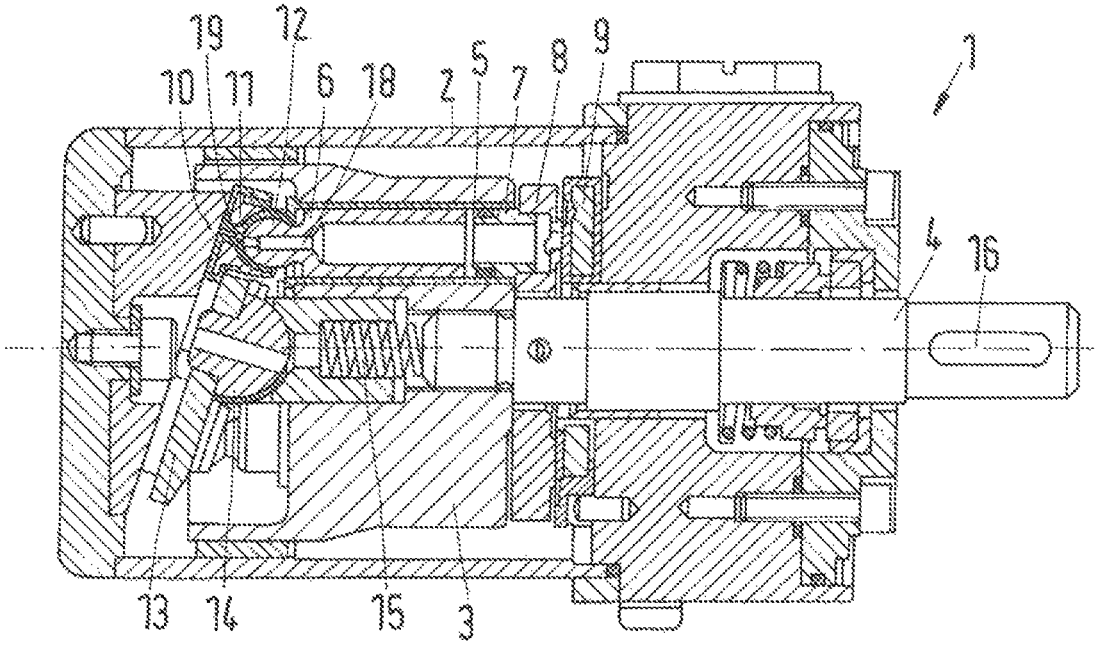
FIG. 1 shows a schematic sectional view through an axial piston machine.

A hydraulic axial piston machine 1 comprises a housing 2, in which a cylinder drum 3 is rotatably supported. The cylinder drum 3 is unrotatably connected to a drive shaft 4.

Several cylinders 5 are located and uniformly distributed in the circumferential direction in the cylinder drum 3. A piston 6 is moveably guided in each cylinder 5. The cylinder 5 is connected to a valve plate 8 via a connecting socket 7, the valve plate 8 interacting with a control plate 9. During operation, the valve plate 8 rotates in relation to the control plate 9.

In the present case, the axial piston machine 1 is a pump. To this end the drive shaft 4 is driven from the outside by applying a torque to the drive shaft 4.

The drive of the piston 6 occurs via a swash plate 10. Each piston 6 is connected to a slipper 11 (which can also be termed "slide shoe"), the connection being made by means of a ball 12, so that the slipper 11 can be tilted in relation to the piston 6. By means of a pressure plate 13 the slippers 11 are kept to bear on the swash plate 10. The pressure plate 13 again is supported on the cylinder drum 3 via a ball joint 14 and a spring 15.

When the cylinder drum 3 rotates about an axis of rotation 16 under the effect of the above mentioned torque acting upon the drive shaft 4, the pistons 6 are reciprocated, known per se, in the axial direction of the cylinder drum 3 by the slippers 11 bearing on the swash plate 10.

If, on the other hand, the cylinders 5 are supplied with hydraulic fluid in the right position, the shaft 4 is rotated, and the machine works as a motor.

In any case the slippers 11 are pressed against swash plate 10 by means of a pressure acting in the respective cylinder 5. This causes a corresponding friction between slipper 11 and swash plate 10 which produces wear. In order to minimize such wear and to reduce frictional losses, each slipper 11 is provided with a pressure area 17 shown in FIG. 2. Pressure area 17 is connected to the interior of cylinder 5 by means of a channel 18 in ball 12 which is connected to an opening 19 in the slipper 11.

Figure 2:
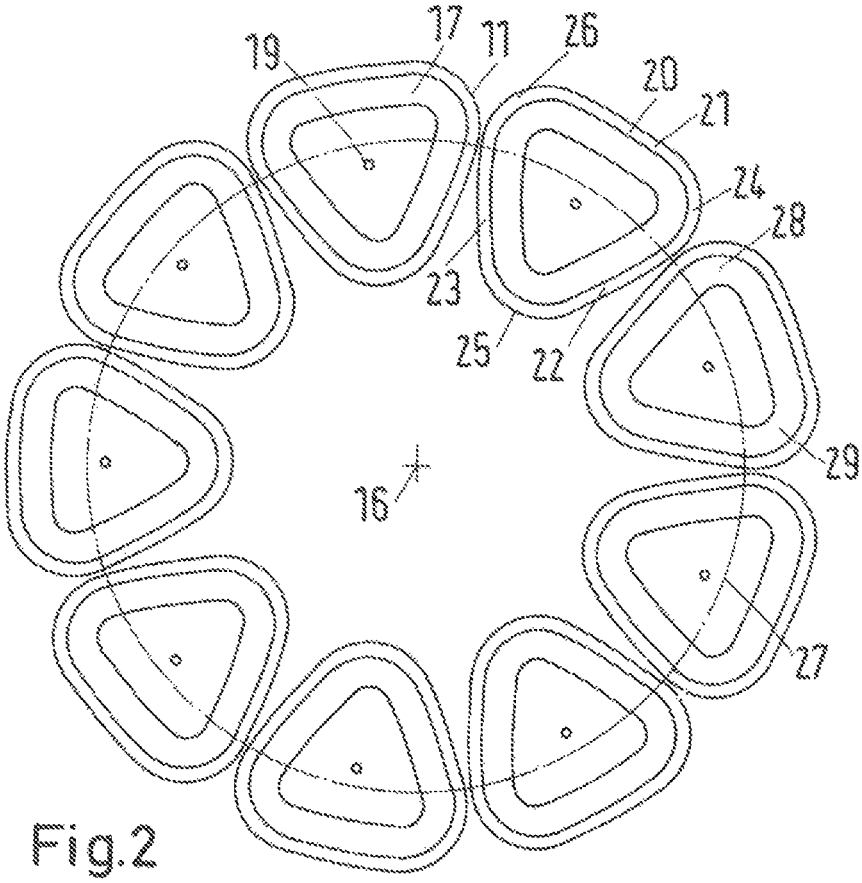
FIG. 2 shows a schematic illustration of pressure areas of slippers of the axial piston machine according to FIG. 1.

As it comes out from FIG. 2, the pressure area 17 deviates from a circular form. The pressure area 17 has a wedge-like form and is almost of triangular form.

To this end the pressure area 17 is limited by a wall 20 which has three straight sections 21, 22, 23 and three rounded edge sections 24, 25, 26, wherein each of the rounded edge sections 24, 25, 26 connects two of the straight sections 21, 22, 23. The straight sections 21, 22, 23 can be slightly curved.

FIG. 2 shows a circle line 27 around the axis of rotation 16. This circle line 27 represents the line along which a middle axis of cylinders 5 moves when cylinder drum 3 is rotated. It can be seen that said pressure area 17 comprises a radially inner border, i.e. rounded section 25, and a radially outer border, i.e. straight section 21, wherein said radially inner border has a larger distance to said circle line 27 than said radially outer border. In other words, rounded section 25 is further away from the circle line 27 than the straight section 21.

The pressure area 17 comprises in an area radially outside said circle line 27 at least one enlargement 28, 29 extending in circumferential direction around said axis of rotation 16. This enlargement 28, 29 is basically located at the inner sides of rounded sections 24, 25.

Two of the rounded edge sections 24, 26 are located radially outside said circle line 27 and one rounded edge section 25 is located radially inside said circle line 27. It is, however, possible to replace rounded edge section 25 by two edge sections connected by a straight section or even more edge sections so that more than one rounded section 25 is located on the radially inner side of circle line 27. In the same way it is possible to replace straight section 21 by some edge sections connected by other straight sections so that more than two rounded sections 24, 26 are located radially outside the circle line 27.

In any case, it is preferred that the pressure area 17 is symmetric with respect to a radius line of the circle line 27. Furthermore, it is preferred that the pressure area has three axis of symmetry, i.e. corresponds to a triangle having three equal sides.

The opening 19 of channel 18 is located on a radially inner side of the circle line 27. This opening 19 is located in the center of the pressure area 17. This allows for a uniform distribution of the pressure coming from the cylinder 5 in the pressure area 17.

Figure 3:
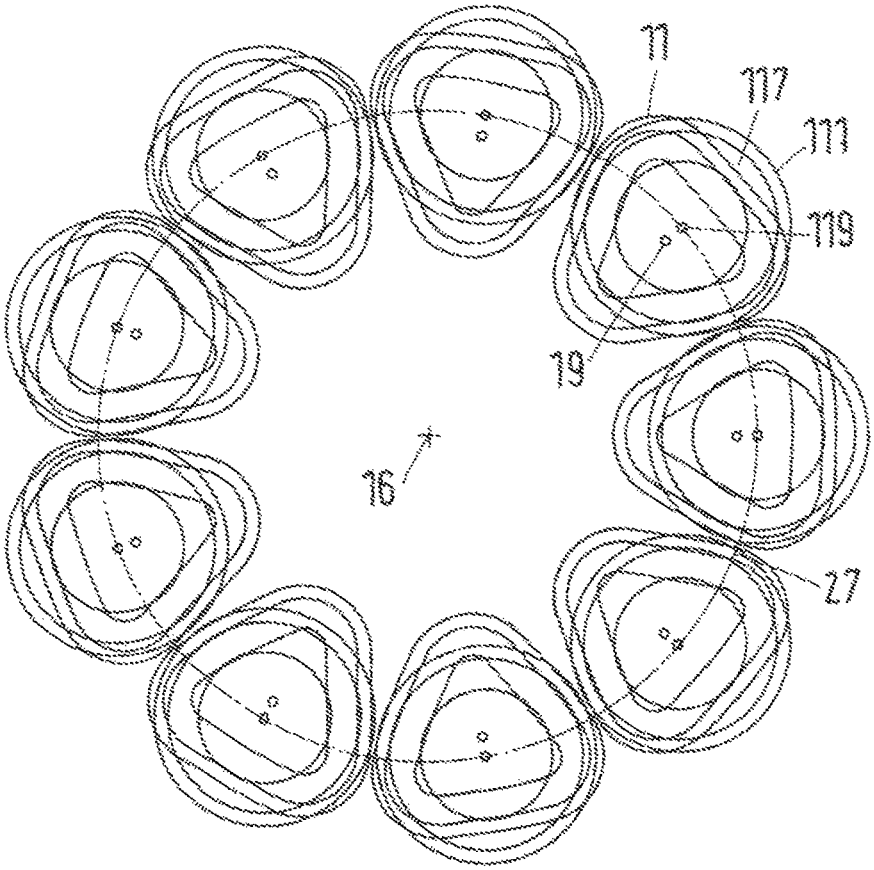
FIG. 3 shows schematically a comparison between pressure areas according to the prior art and according to the present invention.

FIG. 3 shows an illustration allowing a comparison between the pressure shoes 11 described above and pressure shoes 111 according to prior art embodiments.

The prior art embodiments have a pressure shoe 111 with a pressure area 117 of circular form. This circular form corresponds to the largest possible circle around the cylinder axis 16 in the cylinder drum 3. The diameter of this largest possible circle depends on the diameter of the cylinder drum 3 and the number of cylinders 5 in cylinder drum 3.

It can be seen that the pressure area of the new pressure shoes 11 extends radially inwardly further than the pressure area of pressure shoe 111. On the other hand, on the radially outside of circle line 27 the pressure shoe 111 of prior art embodiments extends further than the pressure area of the new pressure shoe 111. However, the new pressure shoe 11 extends radially outside the circle line 27 further in circumferential direction than the pressure area of pressure shoe 111 of prior art embodiments.

In prior art embodiments the opening 119 is located on the circle line 27. In the new slipper 11 the opening 19 is located on the radial inside of circle line 27.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. An axial piston machine comprising a cylinder drum rotatable around an axis of rotation and having at least a cylinder, a piston arranged in said cylinder, a swash plate arranged in front of said cylinder drum, said piston being provided with a slipper resting against said swash plate and having a pressure area on a side facing said swash plate, wherein a cylinder axis of said cylinder is arranged on a circle line around said axis of rotation, characterized in that said pressure area deviates from a circular form.

2. The axial piston machine according to claim 1, wherein said pressure area comprises a radially inner border and a radially outer border and said radially inner border has a larger distance to said circle line than said radially outer border.

3. The axial piston machine according to claim 2, wherein said radially inner border has a distance to said circle line which is larger than a distance of the circumference of the largest possible circle around said cylinder axis defined by a size of said cylinder drum and the number of cylinders of said cylinder drum.

4. The axial piston machine according to claim 3, wherein said pressure area has a wedge-like form.

5. The axial piston machine according to claim 3, wherein said pressure area is limited by a wall having straight sections, said straight sections being connected by rounded sections.

6. The axial piston machine according to claim 2, wherein said pressure area comprises in an area radially outside said circle line at least one enlargement extending in circumferential direction around said axis of rotation.

7. The axial piston machine according to claim 2, wherein said pressure area has a wedge-like form.

8. The axial piston machine according to claim 2, wherein said pressure area is limited by a wall having straight sections, said straight sections being connected by rounded sections.

9. The axial piston machine according to claim 2, wherein said pressure area is symmetric with respect to a radius line of said circle line.

10. The axial piston machine according to claim 1, wherein said pressure area comprises in an area radially outside said circle line at least one enlargement extending in circumferential direction around said axis of rotation.

11. The axial piston machine according to claim 10, wherein said pressure area has a wedge-like form.

12. The axial piston machine according to claim 10, wherein said pressure area is limited by a wall having straight sections, said straight sections being connected by rounded sections.

13. The axial piston machine according to claim 1, wherein said pressure area has a wedge-like form.

14. The axial piston machine according to claim 13, wherein said pressure area is limited by a wall having straight sections, said straight sections being connected by rounded sections.

15. The axial piston machine according to claim 1, wherein said pressure area is limited by a wall having straight sections, said straight sections being connected by rounded sections.

16. The axial piston machine according to claim 15, wherein at least two rounded sections are located radially outside said circle line and at least one rounded section is located radially inside said circle line.

17. The axial piston machine according to claim 1, wherein said pressure area is symmetric with respect to a radius line of said circle line.

18. The axial piston machine according to claim 17, wherein said pressure area has three axis of symmetry.

19. The axial piston machine according to claim 1, wherein said cylinder is connected to said pressure area by a channel running through said piston, said channel opening into said pressure area at a position on a radially inner side of said circle line.

20. The axial piston machine according to claim 19, wherein said position is located in the center of said pressure area.

* * * * *